US008708874B2

(12) United States Patent
Chen

(10) Patent No.: US 8,708,874 B2
(45) Date of Patent: Apr. 29, 2014

(54) ABDOMINAL EXERCISE EQUIPMENT

(75) Inventor: Jui-Yao Chen, Yongjing Township, Changhua County (TW)

(73) Assignee: Tristar Products Inc., Fairfield, NJ (US)

( * ) Notice: Subject to any disclaimer, the term of this patent is extended or adjusted under 35 U.S.C. 154(b) by 168 days.

(21) Appl. No.: 13/452,856

(22) Filed: Apr. 21, 2012

(65) Prior Publication Data

US 2013/0281270 A1 Oct. 24, 2013

(51) Int. Cl.

| | |
|---|---|
| ***A63B 21/00*** | (2006.01) |
| ***A63B 21/02*** | (2006.01) |
| ***A63B 21/045*** | (2006.01) |
| ***A63B 21/22*** | (2006.01) |

(52) U.S. Cl.

USPC ..... 482/132; 482/126; 482/127; 482/110

(58) Field of Classification Search

USPC ..... 482/92–96, 110, 114–116, 121, 122, 482/126, 127, 131–133, 135–137, 140, 141, 482/148; 601/1, 46, 49, 51, 52, 67, 69, 70, 601/72, 99, 100

See application file for complete search history.

(56) References Cited

U.S. PATENT DOCUMENTS

| | | | | | |
|---|---|---|---|---|---|
| 3,861,382 | A * | 1/1975 | Simjian | 601/132 |
| 4,136,867 | A * | 1/1979 | Wilkin | 482/132 |
| 5,123,406 | A * | 6/1992 | Masuda | 601/72 |
| 6,017,296 | A * | 1/2000 | Tang et al. | 482/132 |
| 6,071,217 | A * | 6/2000 | Barnett | 482/121 |
| 6,146,318 | A * | 11/2000 | Kuo | 482/132 |
| 6,174,269 | B1 * | 1/2001 | Eschenbach | 482/132 |
| 6,254,518 | B1 * | 7/2001 | Yu | 482/140 |
| 6,264,587 | B1 * | 7/2001 | Lee | 482/132 |
| 6,338,703 | B1 * | 1/2002 | Yu | 482/132 |
| 6,348,027 | B1 * | 2/2002 | Lee | 482/132 |
| 6,354,983 | B1 * | 3/2002 | Lee | 482/132 |
| 6,368,259 | B1 * | 4/2002 | Liao et al. | 482/132 |
| 6,409,639 | B1 * | 6/2002 | Kuo | 482/140 |
| 6,544,153 | B2 * | 4/2003 | Lee | 482/136 |
| 6,634,995 | B1 * | 10/2003 | Reed | 482/92 |
| 6,638,201 | B1 * | 10/2003 | Dischler | 482/132 |
| 6,857,993 | B2 * | 2/2005 | Yeh | 482/92 |
| 7,041,072 | B2 * | 5/2006 | Calvert | 601/111 |
| 2002/0025894 | A1 * | 2/2002 | Fernandez | 482/140 |
| 2002/0123416 | A1 * | 9/2002 | Huang | 482/140 |
| 2003/0073937 | A1 * | 4/2003 | Guitay | 601/6 |
| 2005/0009672 | A1 * | 1/2005 | Yeh | 482/115 |
| 2006/0211961 | A1 * | 9/2006 | Meyer et al. | 601/73 |
| 2009/0176635 | A1 * | 7/2009 | Brinson | 482/141 |
| 2011/0143895 | A1 * | 6/2011 | Tang | 482/132 |

* cited by examiner

*Primary Examiner* — Loan Thanh
*Assistant Examiner* — Garrett Atkinson
(74) *Attorney, Agent, or Firm* — Muncy, Geissler, Olds & Lowe, P.C.

(57) ABSTRACT

An abdominal exercise equipment is provided with two front wheels and two rear wheels to ensure that the abdominal exercise equipment can move stably without tipping over during movement, preventing the exerciser from losing balance and getting hurt. A return gear assembly is disposed between the two rear wheels to produce a recovering force. Therefore, when the abdominal exercise equipment is pulled back, the recovering force will assist the exerciser to pull the abdominal exercise equipment back, which consequently lowers the difficult level of exercise. Furthermore, the abdominal exercise equipment is provided with a vibration device which is capable of softening the muscles and fat, and speeding up fat loss by producing vibration.

10 Claims, 11 Drawing Sheets

ABDOMINAL EXERCISE EQUIPMENT

BACKGROUND OF THE INVENTION

1. Field of the Invention

The present invention relates to an exercise equipment, and more particularly to an abdominal exercise equipment which is capable of softening the muscles and fat, and speeding up fat loss by producing vibration.

2. Description of the Prior Art

Referring to FIG. 1, an exercise equipment which is an abdominal wheel 10 comprises a wheel body 11 and two handles 12 extending in the axial direction Y at both sides of the wheel body 11. The exerciser grips the handles 12 with two hands to roll out the abdominal wheel 10 on the ground and then pulls it back without the body touching the ground. Rolling the abdominal wheel 10 requires strong abdominal muscles.

It is to be noted that the abdominal wheel 10 only has the single wheel body 11 with limited width, therefore, it is difficult for an exerciser with weak abdominal muscles to keep balance when doing workout with the abdominal wheel 10, and the exerciser may get hurt when loosing balance.

The present invention has arisen to mitigate and/or obviate the afore-described disadvantages.

SUMMARY OF THE INVENTION

The primary object of the present invention is to provide an abdominal exercise equipment which is provided with two front wheels and two rear wheels, which ensures that the abdominal exercise equipment moves stably without tipping over during movement, preventing the exerciser from losing balance and getting hurt.

Another object of the present invention is to provide an abdominal exercise equipment which employs a return gear assembly disposed between the two rear wheels to produce a recovering force. Therefore, when the abdominal exercise equipment is pulled back, the recovering force will assist the exerciser to pull the abdominal exercise equipment back, which consequently lowers the difficult level of exercise.

Yet another object of the present invention is to provide an abdominal exercise equipment which is provided with a vibration device which is capable of softening the muscles and fat, and speeding up fat loss by producing vibration.

To achieve the above objects, an abdominal exercise equipment in accordance with the present invention comprises: a housing, a rear wheel assembly, a front wheel assembly, a vibration device, a return gear assembly, and two handles. The housing includes a longitudinal direction and is formed with a receiving chamber. A base of the housing is formed at both sides thereof in the longitudinal direction with two opposite rear-wheel holes, two opposite front-wheel holes, and an assembling hole between the two front-wheel holes. The housing is formed at both sides thereof in the longitudinal direction with two inserting holes. The rear wheel assembly includes two rear wheels and a gear shaft and is disposed in the receiving chamber in such a manner that the two rear wheels are inserted through the two rear-wheel holes and exposed out of the housing. The front wheel assembly includes two front wheels and a connecting shaft. The connecting shaft includes a transverse shaft connected between the two front wheels, and in the middle of the transverse shaft is formed a longitudinal shaft to be inserted through the assembling hole of the housing. The vibration device is disposed in the receiving chamber of the housing and includes an eccentric wheel and a power source. The power source is electrically connected to an electric power supply unit and serves to rotate the eccentric wheel, so as to produce vibration. The return gear assembly is disposed in the receiving chamber and comprises a gear and two return members. The gear includes a central shaft inserted in the two return members, each of the return members includes an elastic portion in a middle thereof, a transverse leg at one end of the elastic portion to engage with the gear, and a longitudinal leg at another end of the elastic portion to engage with the housing. The return gear assembly further includes a two-step gear with a first step portion to be engaged with the gear shaft and a second step portion to be engaged with the gear, and the first step portion has a diameter greater than the second step portion. The two handles each include an, assembling member which has one end inserted in the inserting holes of the housing and another end pivotally connected to a gripping rod. The gripping rod of one of the handles is provided with a vibration-control switch to control the power source.

DETAILED DESCRIPTION OF THE PREFERRED EMBODIMENTS

The present invention will be clearer from the following description when viewed together with the accompanying drawings, which show, for purpose of illustrations only, the preferred embodiment in accordance with the present invention.

Figure 1:
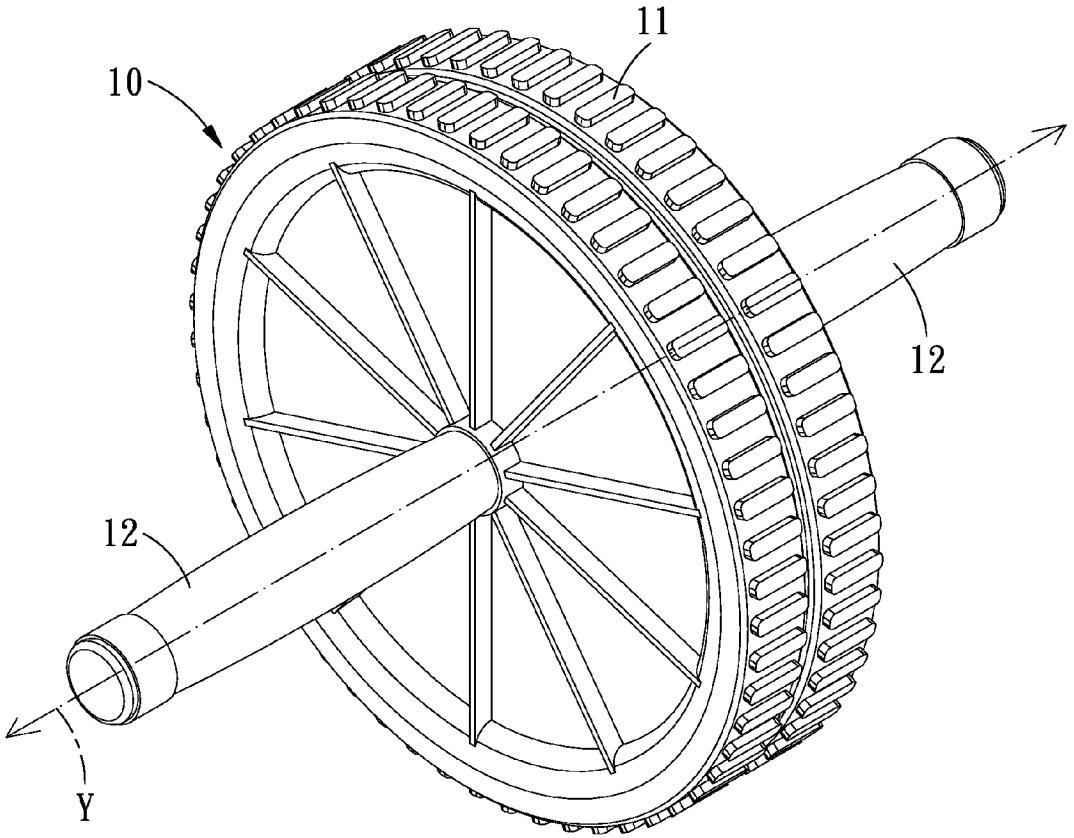
FIG. 1 PRIOR ART
FIG. 1 is a perspective view of a conventional abdominal exercise equipment.
Figure 2:
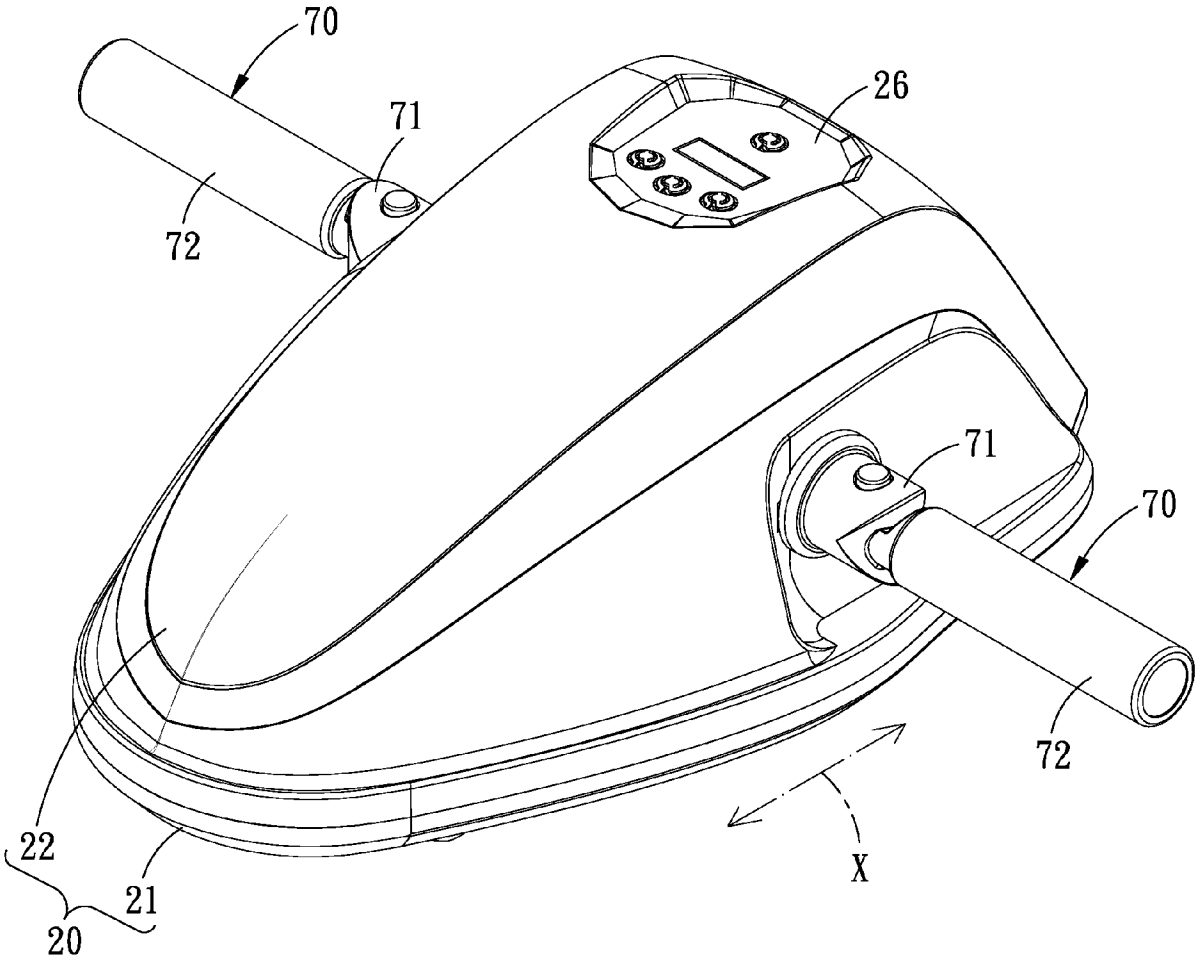
FIG. 2 is a perspective view of an abdominal exercise equipment in accordance with the present invention.
Figure 3:
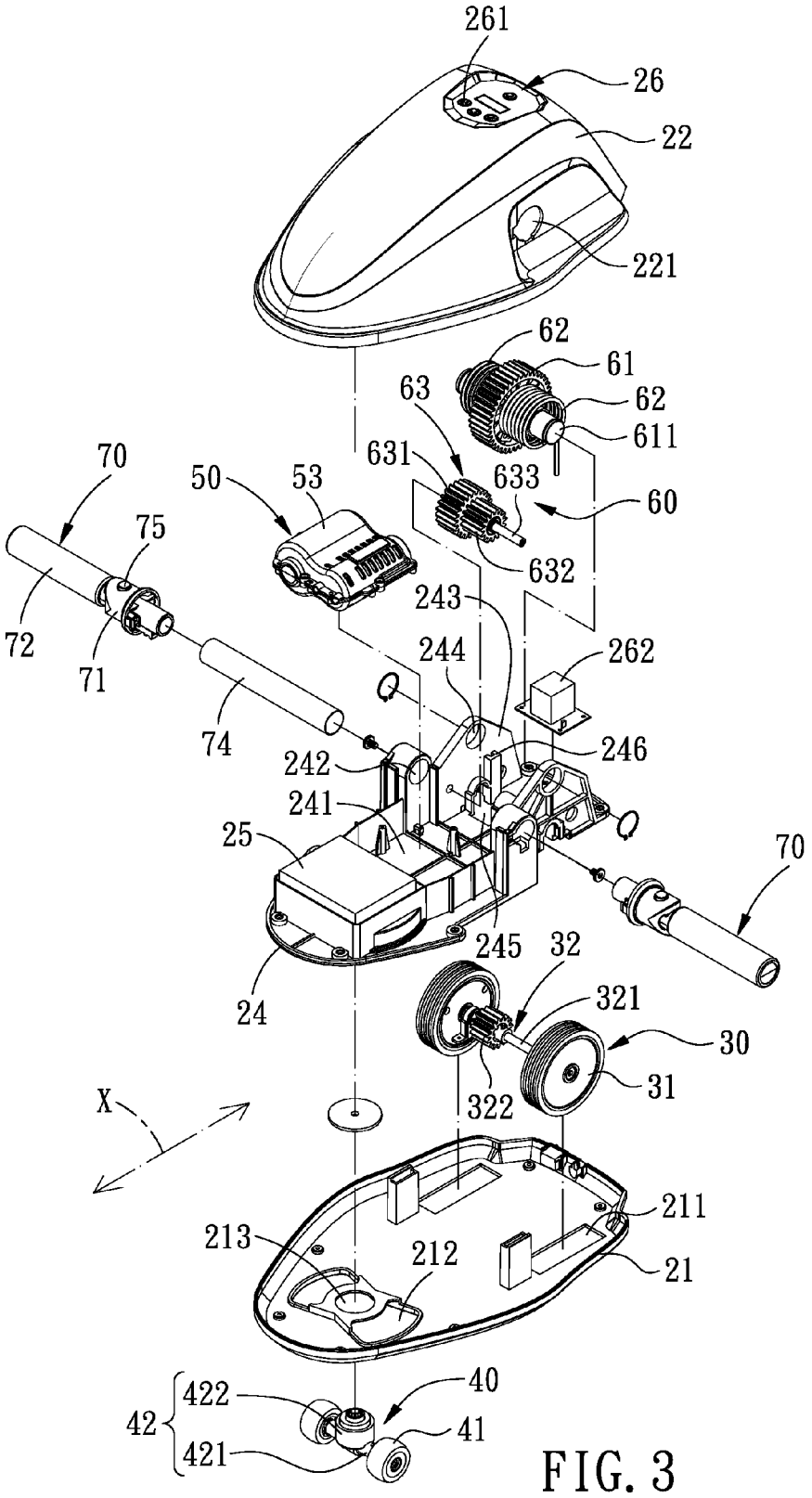
FIG. 3 is an exploded view of the abdominal exercise equipment in accordance with the present invention.
Figure 4A:
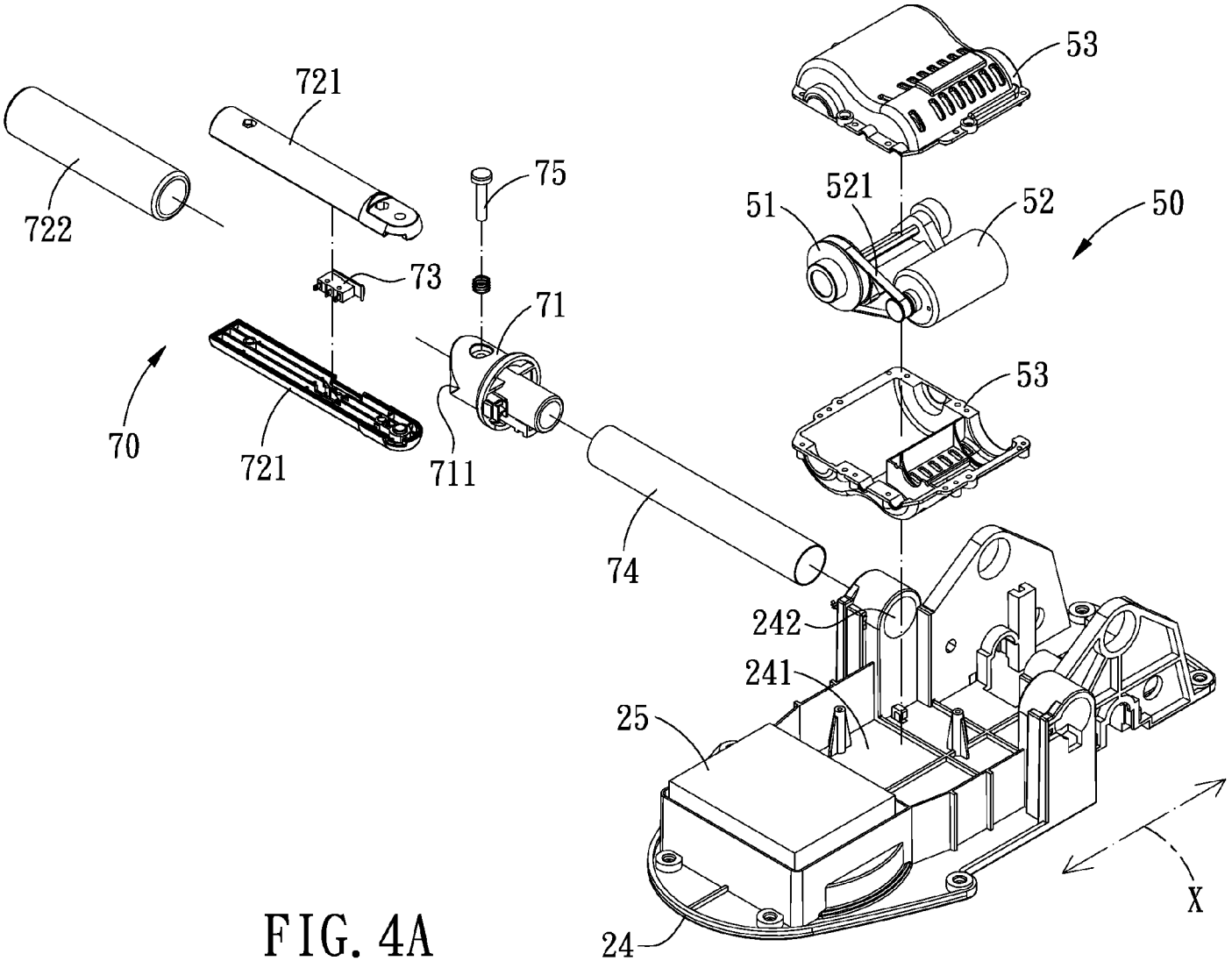
FIG. 4A is an exploded view of a vibration device and the handles of the abdominal exercise equipment in accordance with the present invention.
Figure 4B:
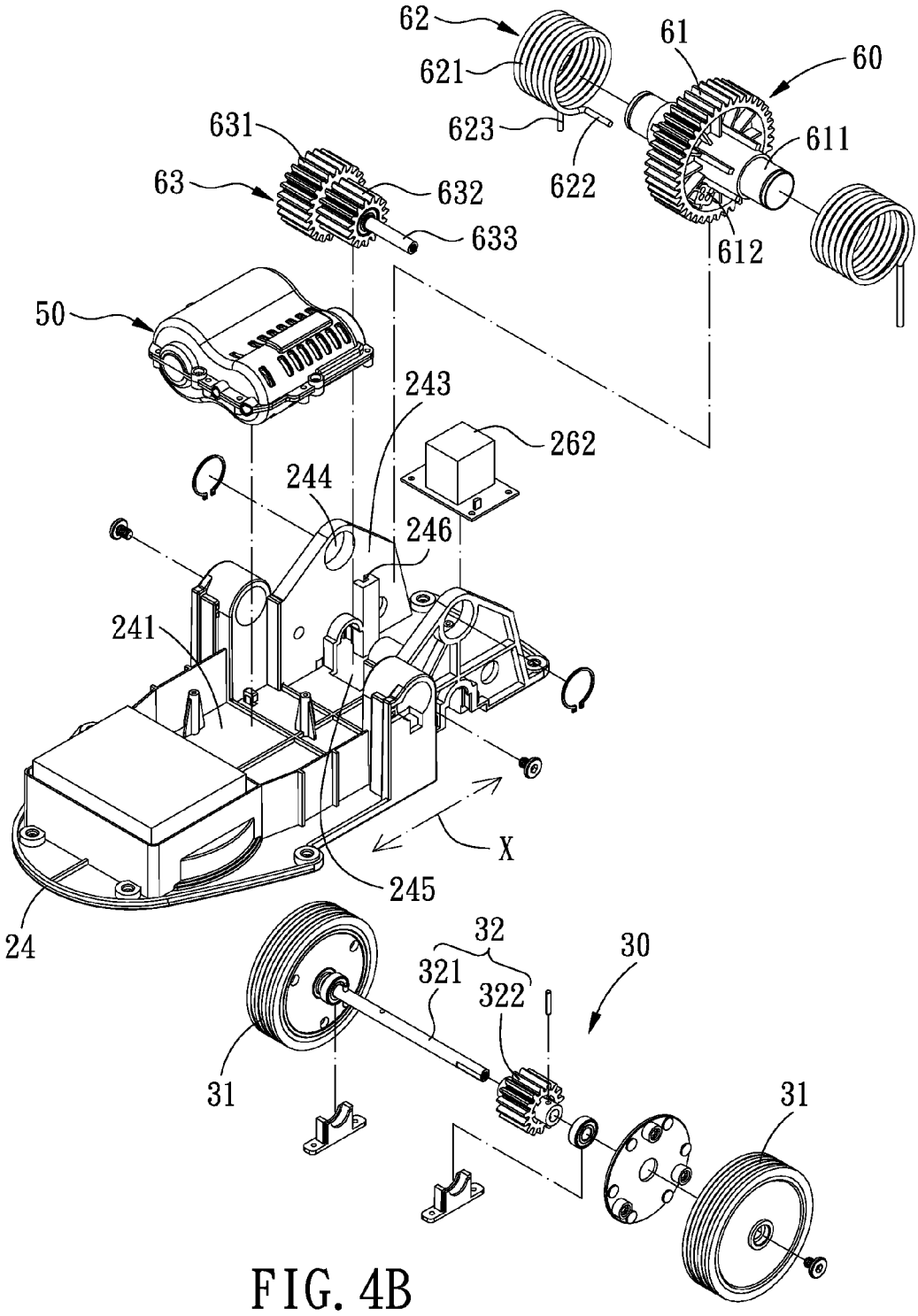
FIG. 4B is an exploded view of a return gear assembly and the rear wheel assembly of the abdominal exercise equipment in accordance with the present invention.
Figure 4C:
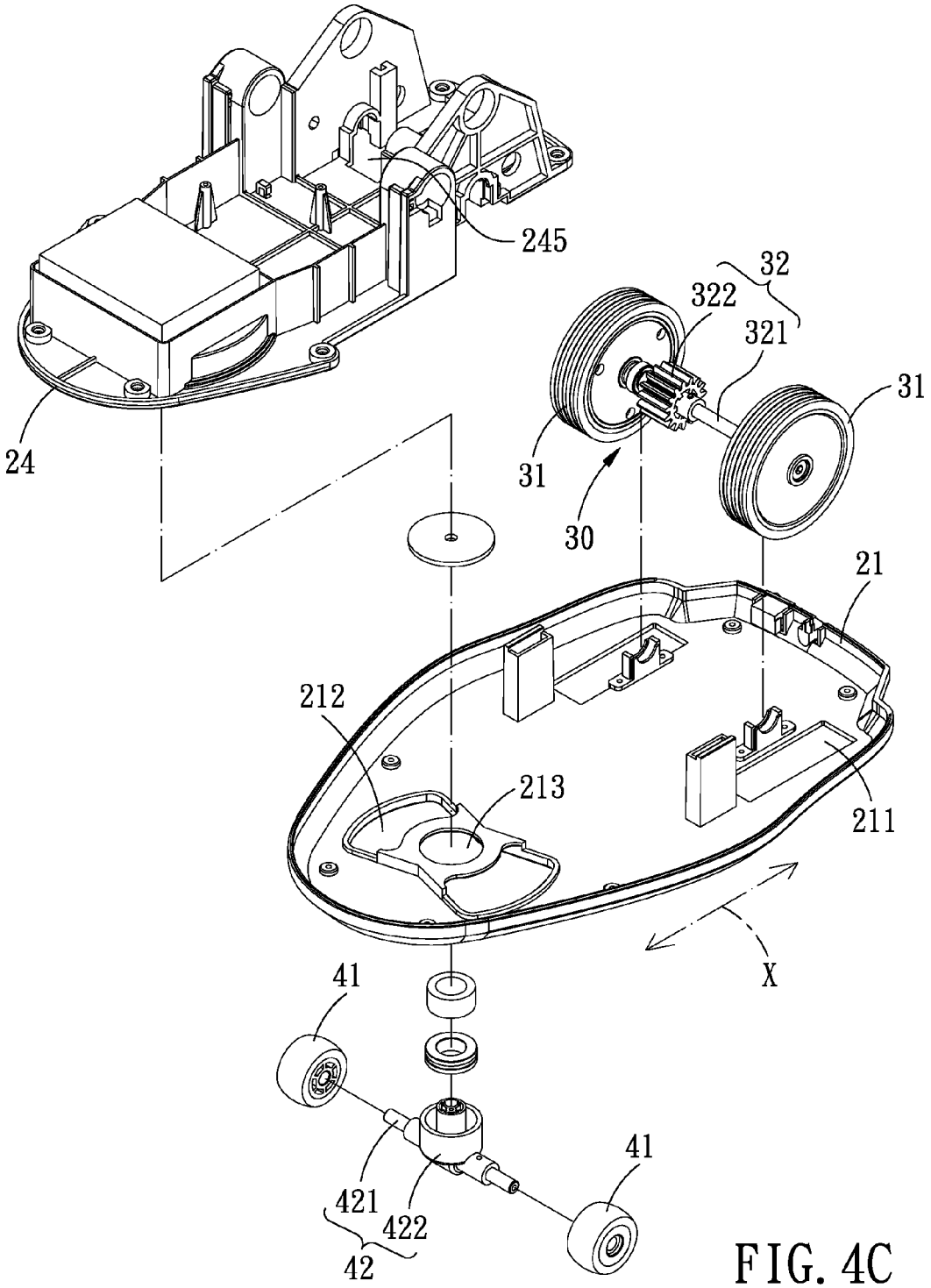
FIG. 4C is an exploded view of a front wheel assembly and the rear wheel assembly of the abdominal exercise equipment in accordance with the present invention.
Figure 5A:
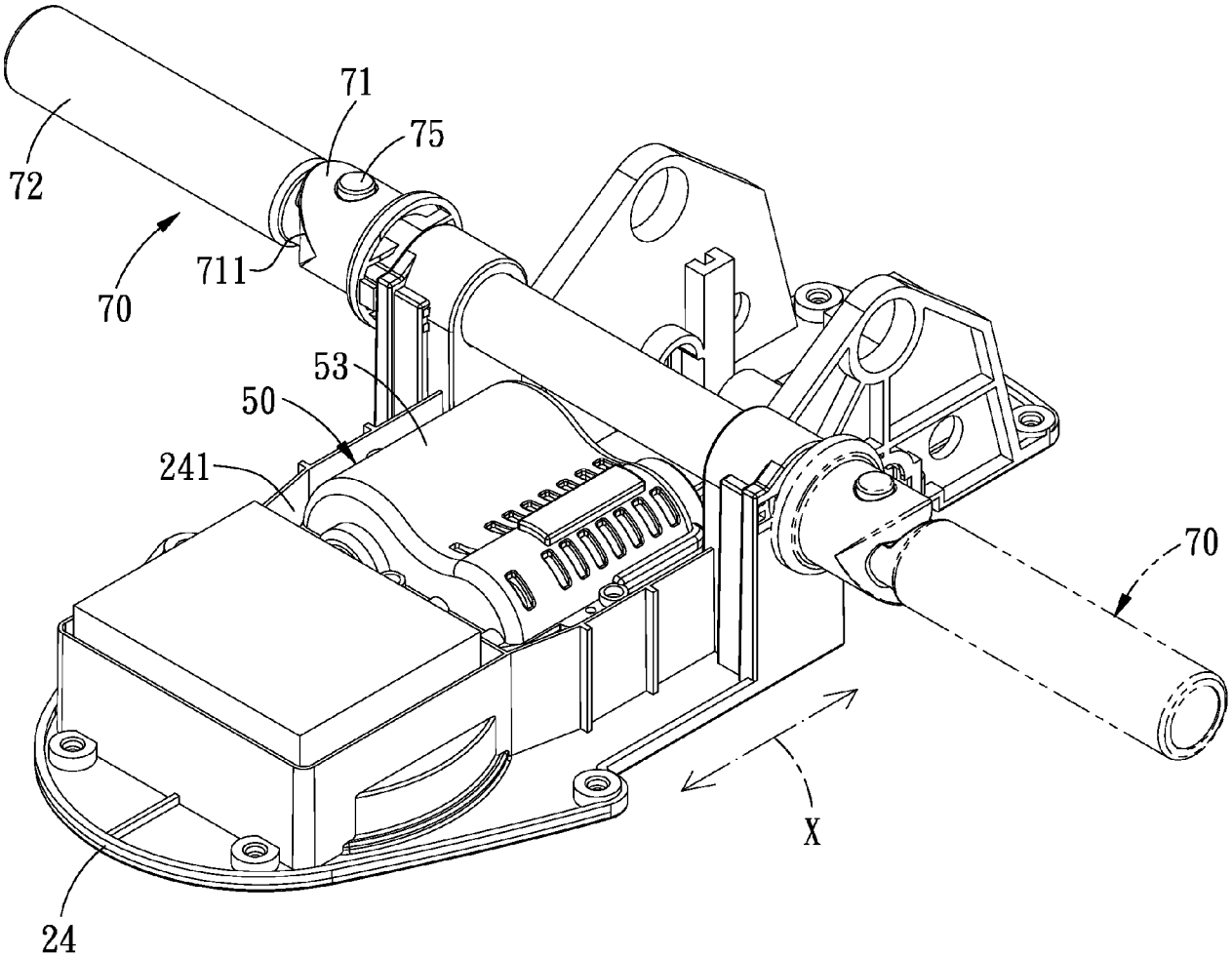
FIG. 5A is an assembly view of the vibration device and the handles of the abdominal exercise equipment in accordance with the present invention.
Figure 5B:
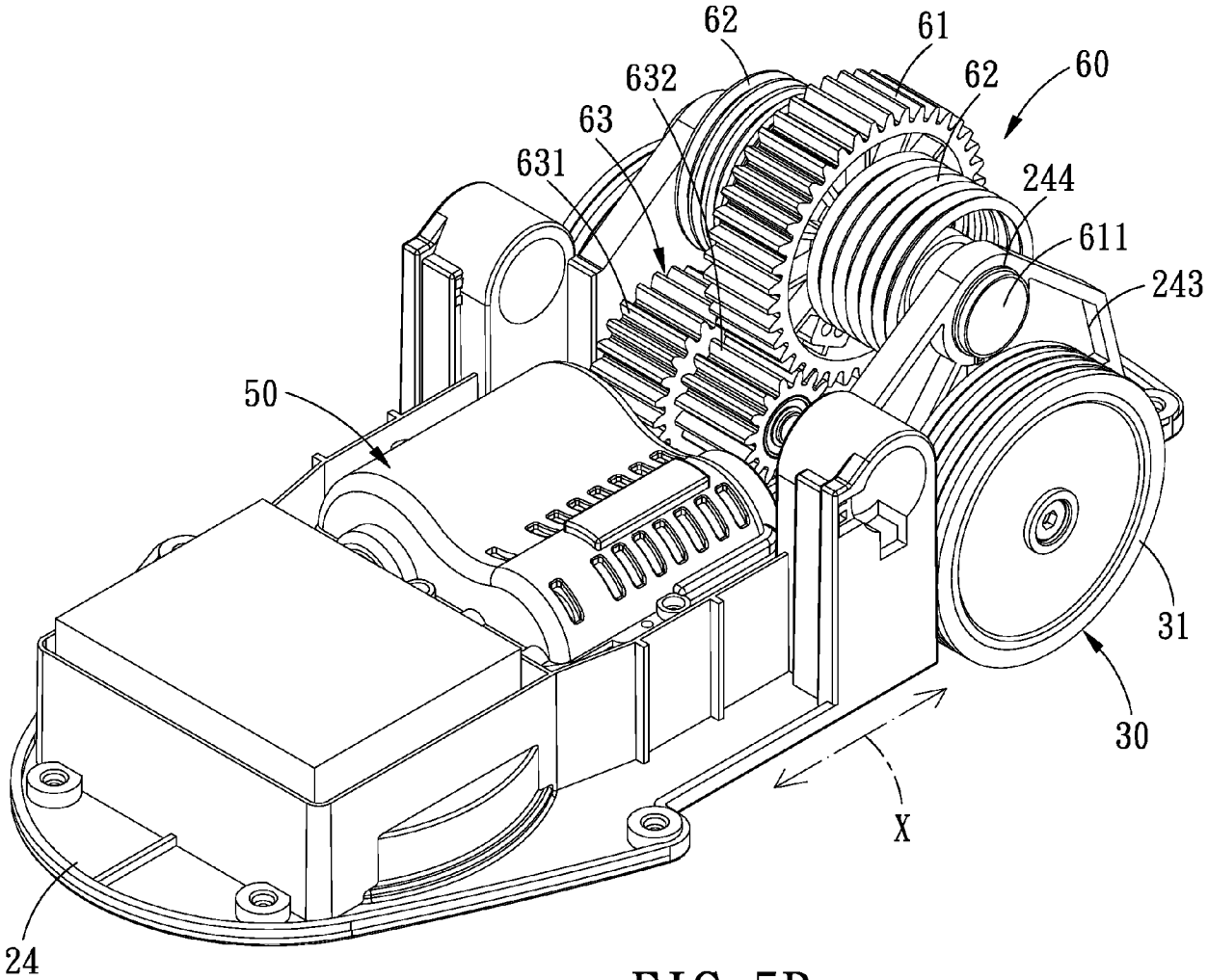
FIG. 5B is an assembly view of the return gear assembly and the rear wheel assembly of the abdominal exercise equipment in accordance with the present invention.
Figure 5C:
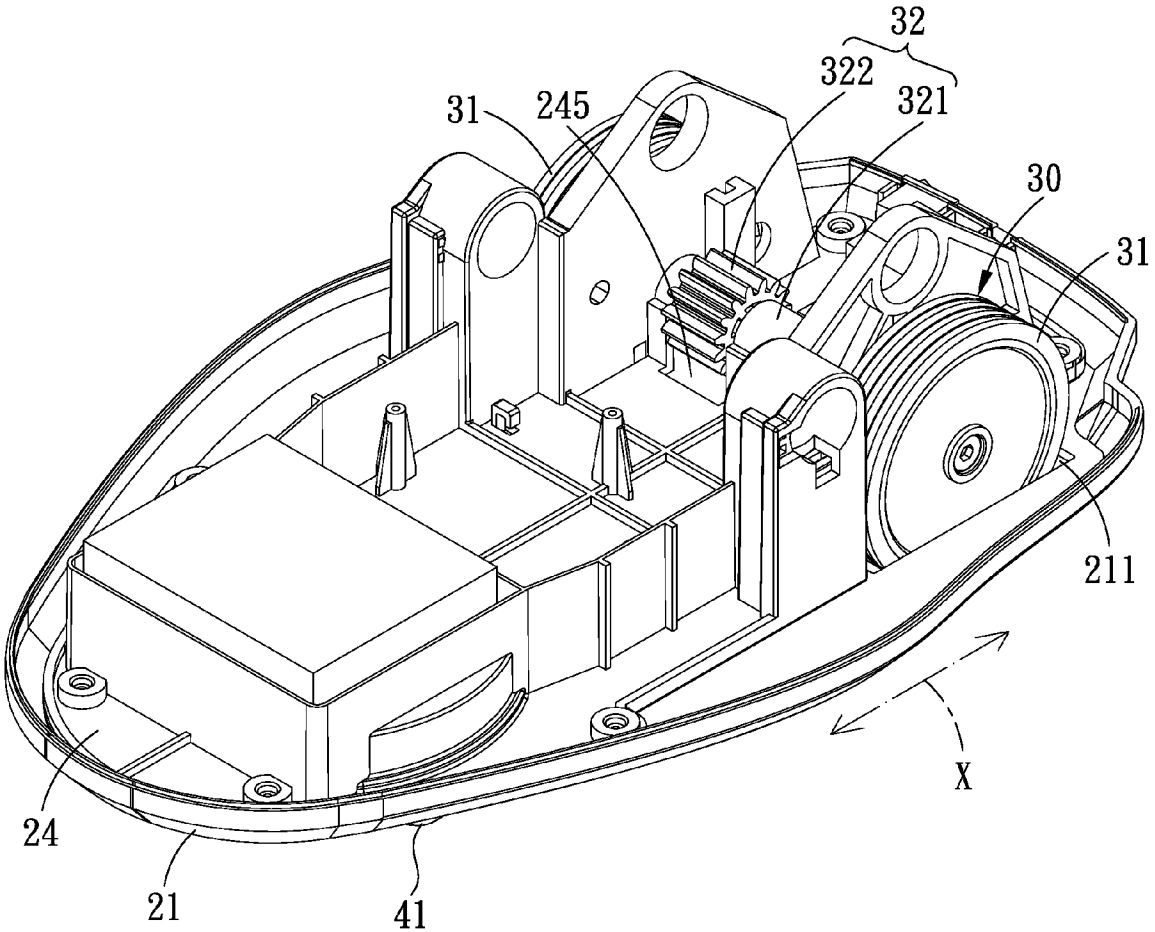
FIG. 5C is an assembly view of the front and rear wheel assemblies of the abdominal exercise equipment in accordance with the present invention.
Figure 6A:
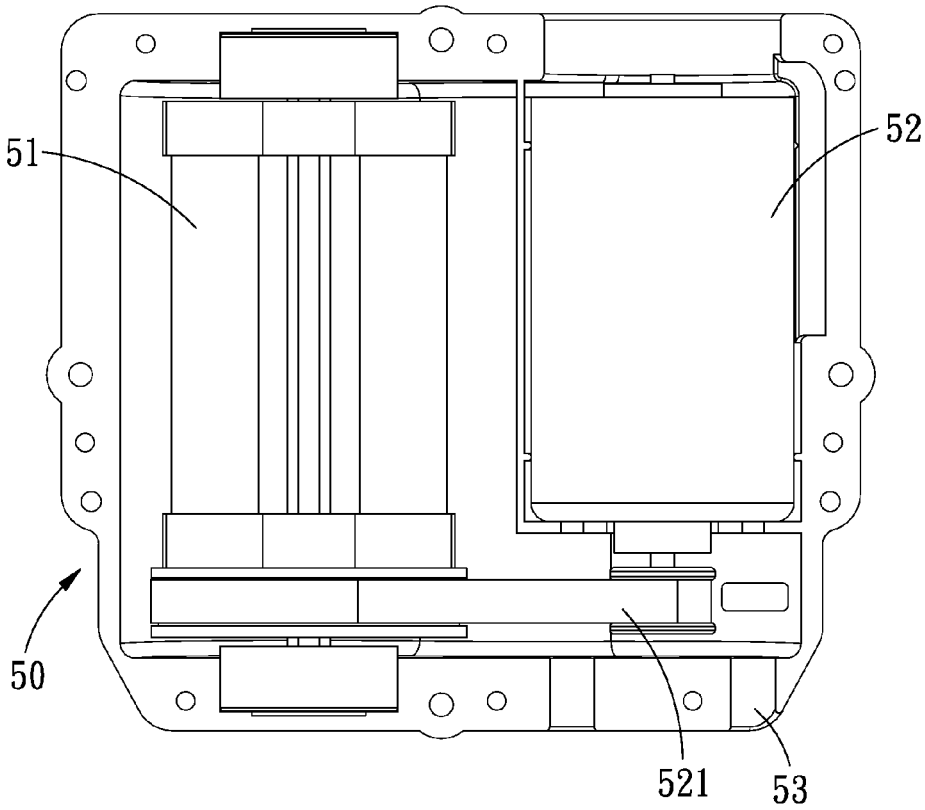
FIG. 6A is a top view of the vibration of the abdominal exercise equipment in accordance with the present invention.
Figure 6B:
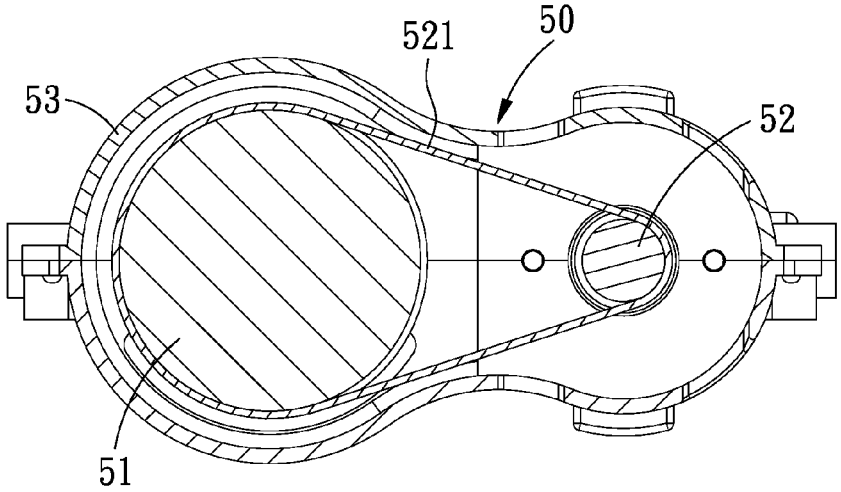
FIG. 6B is a cross sectional view of the vibration device of the abdominal exercise equipment in accordance with the present invention.
Figure 7:
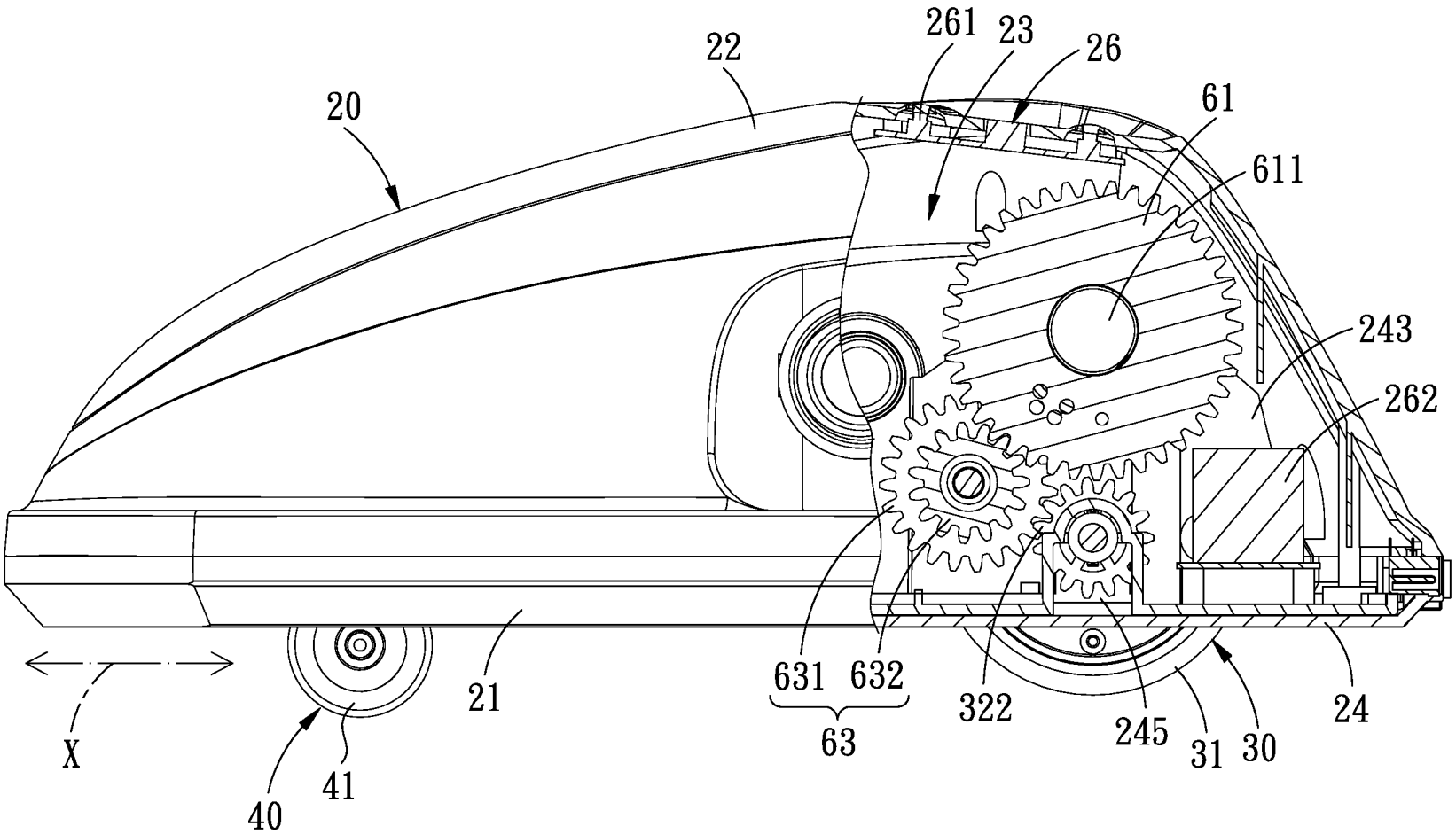
FIG. 7 is a cross sectional view of a part of the abdominal exercise equipment in accordance with the present invention.

Referring to FIGS. 2-7C, an abdominal exercise equipment in accordance with a preferred embodiment of the present invention comprises a rear wheel assembly 30, a front wheel assembly 40, a vibration device 50 and a return gear assembly 60, which are disposed in a housing 20, and two handles 70 at both sides of the housing 20.

The housing 20 includes a longitudinal direction X and is provided with a base 21 and a cover 22 which are assembled together to form to a receiving chamber 23. The base 21 is formed at both sides thereof in the longitudinal direction X with two opposite rear-wheel holes 211, two opposite front-wheel holes 212, and an assembling hole 213 between the two front-wheel holes 212. The cover 22 is formed at both sides thereof in the longitudinal direction X with two inserting holes 221. In the receiving chamber 23 is disposed a mounting frame 24 for mounting and fixing other components. On the top of the front wheel assembly 40 is disposed a weight block 25 to improve the stability of the abdominal exercise equipment.

The mounting frame 24 is formed at the center thereof in the longitudinal direction X with a receiving cavity 241 and further formed with two opposite penetrating holes 242 to be aligned with the inserting holes 221 of the housing 20. The mounting frame 24 is provided at both sides thereof in the longitudinal direction X with two opposite pivot boards 243 which are located adjacent to the rear wheel assembly 30. Each of the pivot boards 243 is formed with a pivot hole 244 and a longitudinal inserting groove 246. Between the two pivot boards 243 is formed a notch 245. The housing 20 is further provided with a control circuit 26 which includes a control panel 261 disposed on the outer surface of the cover 22, and the control circuit 26 is electrically connected to an electric power supply unit 262.

The rear wheel assembly 30 includes two rear wheels 31 and a gear shaft 32 and disposed in the receiving chamber 23 in such a manner that the two rear wheels 31 are inserted through the two rear-wheel holes 211 and exposed out of the housing 20. The gear shaft 32 includes a connecting shaft 321 and a drive gear 322 mounted on the connecting shaft 321, and the connecting shaft 321 is connected between the two rear wheels 31. The gear shaft 32 is received in the notch 245 of the mounting frame 24 with the drive gear 322 exposed out of the notch 245.

The front wheel assembly 40 includes two front wheels 41 and a reverse T-shaped connecting shaft 42 which includes a transverse shaft 421 connected between the two front wheels 41. In the middle of the transverse shaft 421 is formed a longitudinal shaft 422 to be inserted through the assembling hole 213 of the housing 20 and fixed to the mounting frame 24.

The vibration device 50 is disposed in the receiving chamber 23 of the housing 20 and includes an eccentric wheel 51 and a power source 52. The power source 52 is a motor with a drive shaft and electrically connected to the control circuit 26. The power source 52 is connected to the electric power supply unit 262 by the control circuit 26 and serves to rotate the eccentric wheel 51 by using a belt 521, so as to produce vibration. In this embodiment, the vibration device 50 includes a shell 53 in which the eccentric wheel 51 and the power source 52 can be fixed. The shell 53 is disposed in the receiving cavity 241 of the mounting frame 24.

The return gear assembly 60 is disposed in the receiving chamber 23 and comprises a gear 61 and two return members 62. The gear 61 includes a central shaft 611 inserted in the two return members 62. Each of the return members 62 is a helical spring which has an elastic portion 621 in the middle, a transverse leg 622 at one end of the elastic portion 621 to engage with the gear 61, and a longitudinal leg 623 at another end of the elastic portion 621 to engage with the housing 20. The return gear assembly 60 further includes a two-step gear 63 with a first step portion 631 to be engaged with the gear shaft 32 and a second step portion 632 to be engaged with the gear 61, and the first step portion 631 has a diameter greater than the second step portion 632.

The central shaft 611 of the gear 61 has two ends inserted in the pivot holes 244 of the mounting frame 24. The gear 61 is formed with a transverse inserting hole 612 beside the central shaft 611, so that the return members 62 have the transverse legs 622 inserted in the transverse inserting hole 612 and have the longitudinal legs 623 inserted in longitudinal inserting holes 246 of the mounting frame 24. The two-step gear 63 includes a central shaft 633 to be pivotally connected to the two pivot boards 243.

The two handles 70 each include an assembling member 71 which has one end inserted in the inserting holes 221 of the housing 20 and another end pivotally connected to a gripping rod 72. The gripping rod 72 of one of the handles 70 is provided with a vibration-control switch 73 to be electrically connected to the control circuit 26 to control the power source 52. Between the two handles 70 is disposed a hollow pipe 74 to be inserted in the two penetrating holes 242 of the mounting frame 24, and the assembling members 71 are inserted through the inserting holes 221 of the cover 22 and into the hollow pipe 74.

Each of the gripping rods 72 includes two semicircular hollow rods 721 clamped together to form a cylindrical structure, and a sleeve 722 is sleeved on the cylindrical structure. The assembling member 71 of each of the two handles 70 is formed at an end thereof with a pivot notch 711, and the gripping rods 72 are pivotally fixed in the pivot notch 711 by a pivot 75.

The abdominal exercise equipment of the present invention is put on the ground, the exerciser holds the two handles 70 with two hands and keeps feet on the ground, and then does workout by pushing out the abdominal exercise equipment and pulling it back repeatedly, so as to exercise the abdominal muscles. Since the front and rear wheel assemblies 40, 30 of the abdominal exercise equipment of the present invention touch the ground with four wheels, which ensures that the abdominal exercise equipment moves stably without tipping over during movement, preventing the exerciser from losing balance and getting hurt.

To effectively exercise the abdominal muscles, the return gear assembly 60 is disposed between the two rear wheels 31 in such a manner that the transverse legs 622 of the two return members 62 are fixed to the gear 61 of the return gear assembly 60, and the longitudinal legs 623 are fixed to the mounting frame 24. When the abdominal exercise equipment is pushed out, the rear wheels 31 will use the two-step gear 63 to rotate the gear 61, and the transverse legs 622 of the two return members 62 will also be rotated to make the elastic portion 621 of the return members 62 deform and consequently produce a recovering force. Therefore, when the abdominal exercise equipment is pulled back, the recovering force will assist the exerciser to pull the abdominal exercise equipment back, which consequently lowers the difficult level of exercise.

Furthermore, since the exerciser has to use upper limbs when exercising with the abdominal exercise equipment, and the vibration device 50 is disposed between the two handles 70, the vibration produced by the vibration device 50 can be transferred to the exerciser's upper limbs through the two handles 70 to soften the muscles and fat, and speed up fat loss.

While we have shown and described various embodiments in accordance with the present invention, it is clear to those skilled in the art that further embodiments may be made without departing from the scope of the present invention.

What is claimed is:

1. An abdominal exercise equipment comprising:

a housing including a longitudinal direction and being formed with a receiving chamber, a base of the housing being formed at both sides thereof in the longitudinal direction with two opposite rear-wheel holes, two opposite front-wheel holes, and an assembling hole between the two front-wheel holes, the housing being formed at both sides thereof in the longitudinal direction with two inserting holes;

a rear wheel assembly including two rear wheels and a gear shaft and disposed in the receiving chamber in such a manner that the two rear wheels are inserted through the two rear-wheel holes and exposed out of the housing;

a front wheel assembly including two front wheels and a connecting shaft, the connecting shaft including a transverse shaft connected between the two front wheels, in the middle of the transverse shaft being formed a longitudinal shaft to be inserted through the assembling hole of the housing;

a vibration device disposed in the receiving chamber of the housing and including an eccentric wheel and a power source, the power source being electrically connected to an electric power supply unit and serving to rotate the eccentric wheel, so as to produce vibration;

a return gear assembly disposed in the receiving chamber and comprising a gear and two return members, the gear including a central shaft inserted in the two return members, each of the return members including an elastic portion in a middle thereof, a transverse leg at one end of the elastic portion to engage with the gear, and a longitudinal leg at another end of the elastic portion to engage with the housing, the return gear assembly further including a two-step gear with a first step portion to be engaged with the gear shaft and a second step portion to be engaged with the gear, and the first step portion has a diameter greater than the second step portion; and two handles each including an assembling member which has one end inserted in the inserting holes of the housing and another end pivotally connected to a gripping rod, and the gripping rod of one of the handles being provided with a vibration-control switch to control the power source.

2. The abdominal exercise equipment as claimed in claim 1, wherein the housing includes the base and a cover which are assembled together to form to the receiving chamber, the rear-wheel holes, the front-wheel holes, and the assembling hole are formed in the base, and the two inserting holes are formed in the cover.

3. The abdominal exercise equipment as claimed in claim 1, wherein a mounting frame is disposed in the receiving chamber and formed at a center thereof in the longitudinal direction with a receiving cavity, the vibration device includes a shell for holding the eccentric wheel and the power source, and the shell is disposed in the receiving cavity of the mounting frame.

4. The abdominal exercise equipment as claimed in claim 1, wherein a mounting frame is disposed in the receiving chamber and provided at both sides thereof in the longitudinal direction with two opposite pivot boards which are located adjacent to the rear wheel assembly, and between the two pivot boards is formed a notch;

the rear wheel assembly includes a connecting shaft and a drive gear mounted on the connecting shaft, the connecting shaft is connected between the two rear wheels, the gear shaft is received in the notch of the mounting frame, and the drive gear is exposed out of the notch and engaged with the first step portion; and the longitudinal shaft of the front wheel assembly is inserted through the assembling hole of the housing and fixed to the mounting frame.

5. The abdominal exercise equipment as claimed in claim 1, wherein a mounting frame is disposed in the receiving chamber and provided at both sides thereof in the longitudinal direction with two opposite pivot boards which are located adjacent to the rear wheel assembly, each of the pivot boards is formed with a pivot hole and a longitudinal inserting groove; and the central shaft of the gear has two ends inserted in the pivot holes of the mounting frame, the gear is formed with a transverse inserting hole beside the central shaft, so that the return members have the transverse legs inserted in the transverse inserting hole and have the longitudinal legs inserted in longitudinal inserting holes of the mounting frame, and the two-step gear includes a central shaft to be pivotally connected to the two pivot boards.

6. The abdominal exercise equipment as claimed in claim 1, wherein a mounting frame is disposed in the receiving chamber and provided with two opposite penetrating holes to be aligned with the inserting holes of the housing; and a pipe is disposed between the two handles and inserted in the two penetrating holes of the mounting frame, and the assembling members are inserted through the inserting holes of the cover and into the pipe.

7. The abdominal exercise equipment as claimed in claim 1, wherein a weight block is disposed on a top of the front wheel assembly.

8. The abdominal exercise equipment as claimed in claim 1, wherein each of the gripping rods includes two semicircular hollow rods clamped together to form a cylindrical structure, and a sleeve is sleeved on the cylindrical structure, the assembling member of each of the two handles is formed at an end thereof with a pivot notch, and the gripping rods are pivotally fixed in the pivot notch by a pivot.

9. The abdominal exercise equipment as claimed in claim 4, wherein each of the gripping rods includes two semicircular hollow rods clamped together to form a cylindrical structure, and a sleeve is sleeved on the cylindrical structure, the assembling member of each of the two handles is formed at an end thereof with a pivot notch, and the gripping rods are pivotally fixed in the pivot notch by a pivot.

10. The abdominal exercise equipment as claimed in claim 1, wherein the housing is further provided with a control circuit which includes a control panel disposed on an outer surface of the cover, and the control circuit is electrically connected to the electric power supply unit, the power source and the vibration-control switch.

* * * * *